United States Patent [19]

Cake

[11] 3,946,549

[45] Mar. 30, 1976

[54] ELECTRONIC ALARM WATCH

[75] Inventor: Arthur F. Cake, Smithtown, N.Y.

[73] Assignee: Uranus Electronics, Inc., New Rochelle, N.Y.

[22] Filed: Dec. 26, 1973

[21] Appl. No.: 427,834

[52] U.S. Cl. ..... 58/38 R; 58/57.5; 58/152 B; 58/23 R; 58/50 R

[51] Int. Cl.[2] ..... G04C 21/00

[58] Field of Search ..... 58/38, 23 R, 50 R, 152 B, 58/19 R, 57.5

[56] References Cited

UNITED STATES PATENTS

| | | | |
|---|---|---|---|
| 3,646,751 | 3/1972 | Purland et al. | 58/50 R |
| 3,664,116 | 5/1972 | Emerson et al. | 58/50 R |
| 3,745,761 | 7/1973 | Tsuruishi | 58/23 R |
| 3,822,547 | 7/1974 | Fujita | 58/38 |

OTHER PUBLICATIONS

Beuscher, et al. "Electronic Switching Theory and Circuits", Van Nostrand Reinhold Co., New York, 1971, pp. 49–50.

*Primary Examiner*—L. T. Hix
*Assistant Examiner*—U. Weldon
*Attorney, Agent, or Firm*—Bauer, Amer & King

[57] ABSTRACT

An electronic timepiece having a pulse generator for producing a high frequency time standard signal for a first divider circuit producing first low frequency timing signals in response to said time standard signal with logic means controlling said time standard signal in a second divider circuit at programmed times for producing second low frequency time signals, said first low frequency time signals and said second low frequency time signals being connected to comparative means to activate an alarm means when aligned.

8 Claims, 1 Drawing Figure

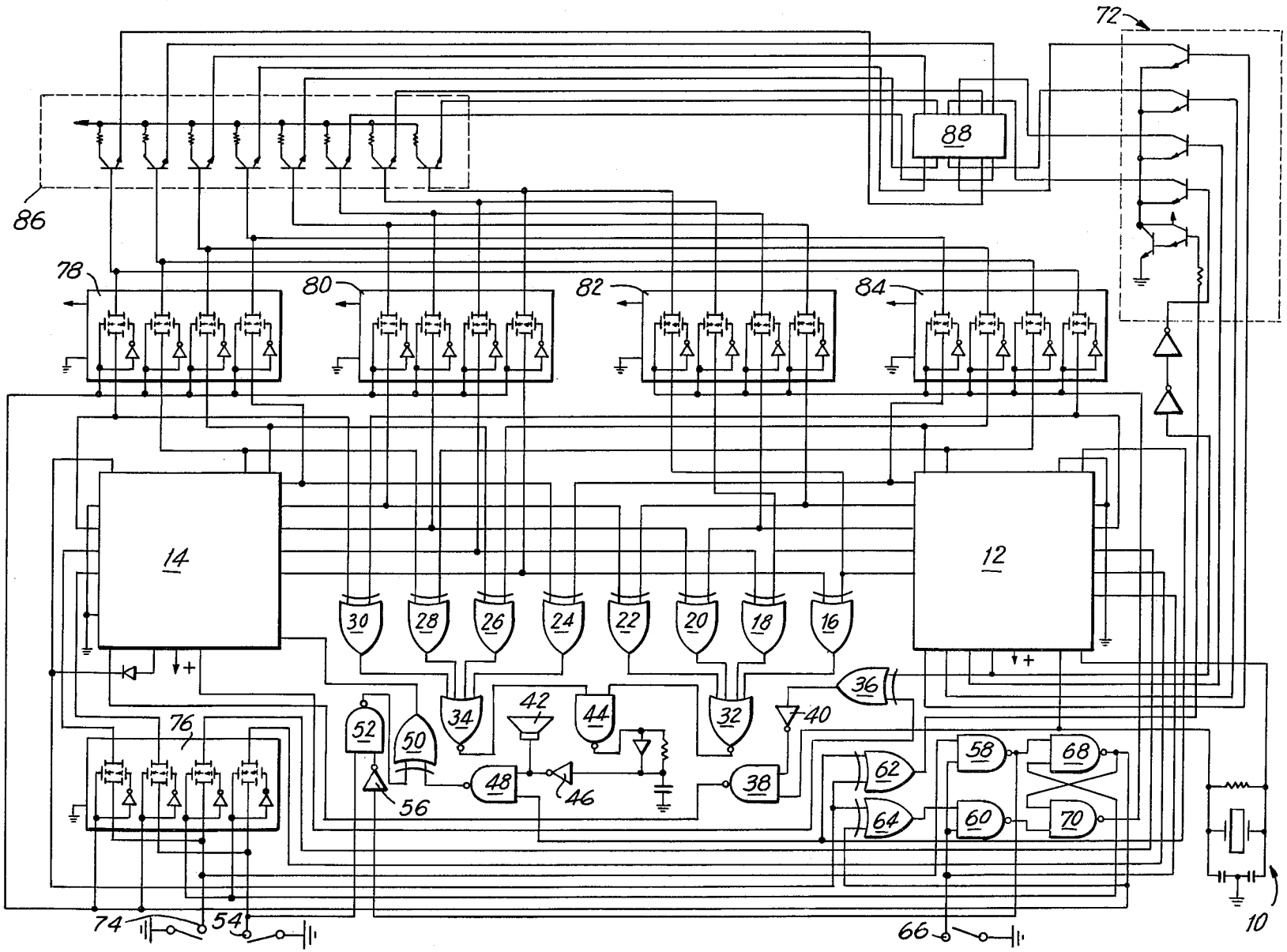
10
12
14
16
18
20
22
24
26
28
30
32
34
36
38
40
42
44
46
48
50
52
54
56
58
60
62
64
66
68
70
72
74
76
78
80
82
84
86
88

ELECTRONIC ALARM WATCH

SUMMARY OF INVENTION

All electronic digital timepieces have recently found there place among the more traditional timepieces, especially in the manufacture of wristwatches. Generally speaking such all electronic timepieces employ a frequency oscillator for generating a high frequency time standard signal for a chip of complementary symmetry divide-down flip-flop tming circuits for producing a low frequency timing signal that is continuously counting. Such chips are sold by Hughes Aircraft Company and Solitron Devices, Inc. under respective part numbers 8216 and CM4120. In addition such chips and their internal functioning are disclosed by prior art U.S. Pat. No. 3,765,163 assigned to the assignee of this invention and U.S. Pat. Nos. 3,672,155; 3,714,867; 3,721,084; 3,742,699 and 3,760,584 to be within the skill of the art in practicing this invention. The only difference of note with such prior art chips is with reference to the output frequency providing the high frequency time standard signal which difference is a matter of design choice also within the skill of the art. These timepieces to date have employed either liquid crystals and light emitting diodes that display the progression of time by means of appropriate segment and digit drivers. In many instances the time display is by demand only to permit minimum power requirements of the timepiece, especially with regard to such timepieces that are battery powered. These timepieces have means to set the electronics in accordance with the accurate time. It is to the improvement of these timepieces that this invention is directed. More specifically, as it is desirable to provide alarm means for such timpieces, it is the intent of this invention to do so by similar electronic means whereby the economies and reliability of such construction can be equally applied to the addition of an alarm means.

The timepiece illustrated in U.S. Pat. No. 3,745,761 provides a particular example of the timepiece and alarm means with which this invention is particularly concerned. In the combination disclosed by U.S. Pat. No. 3,745,761 there is provided mechanical switch means to pulse an alarm circuit of several memory means into a comparator circuit also connected to a divider circuit connected to a pulse generator so as to activate an alarm means when desired. This structure, although apparently satisfactory for its intended purpose, is deficient to the extent of reducing the reliability of continued performance to that of the mechanical switch means. Furthermore, the necessity in this prior art structure of several, four, mechanical switches adds to the expense of manufacture of such a timepiece whereby such timepiece can only be a questionably marketable item.

Accordingly, it is an object of this invention to provide a small-sized all electronic timepiece provided having display means with an electronic alarm circuit which is an improvement over the prior art.

More particularly it is the object of this invention to utilize logic circuitry to mate alarm means with watch means such that the economies and reliability of CMOS technology can be employed.

A further understanding of this and other objects and advantages of this invention will be apparent from the following description of the drawing whose scope shall be provided by the appended claims.

DETAILED DESCRIPTION

With reference to the FIGURE there is shown in logic block diagram the principal parts of an electronic timepiece according to this invention. More particularly, the electronic timepiece is shown to include a tank circuit 10 serving as a tank for an inverter in chip 12 to provide a high frequency time standard signal. The chip 12 also comprises a binary divider chain such as is familiar to those skilled in the art of CMOS technology comprised of a decoder and a plurality of divide down circuits to generate signals corresponding to units and tens of seconds, minutes, hours, days, weeks, and months. The chips 12 and 14 are alike and have several pad like connections (not shown) for connection with the several leads about their periphery from other elements shown in the drawing providing power source and control inputs and pulsing output signals as is known by those skilled in the art. More particularly, and starting with the lower right bottom corner of chip 12 and reading to the left along the bottom there is, as shown, a connection of chip 12 with an input lead from tank circuit 10, a connection for a high frequency time signal from chip 12 to tank circuit 10 and NAND gate 38, a connection with a positive power source, and four connections for the four leads to a digit driver 72 one of which is connected to an input of exclusive OR gate 36. In continuing up the left side of chip 12, as shown by the drawing, and at the left upper corner there is provided seven connections each of which provides an output for seven separate leads shown connected to separate inputs for exclusive OR gates 16, 18, 20, 22, 24, 26, and 28, which leads are further shown to be tapped to separate portions of the transmission gates 82 and 84. Continuing across the top of chip 12 there is shown by the drawing at the top right corner thereof a connection for a ground lead that is also brought to another connection of the chip 12 on the right side around the top corner. At the top right corner is a connection providing a display demand normal output signal familiar with those skilled in the art to a lead to an input for exclusive OR gate 62 that is tapped also to NAND gate 48. Concluding down the right side of chip 12 as shown on the drawing a connection beneath the ground connection aforedescribed is made for a lead to exclusive OR gate 30 that is tapped to a portion of transmission gate 84 to provide an AM/PM signal set forth in more particularity hereinafter, next in descending order on the right side is a connection for a lead from a portion of the transmission gate 76 that is operably connected by a lead to switch 74 which to those skilled in the art will be recognized as providing for an hours minutes demand input to chip 12, thence a connection to another portion of transmission gate 76 operably connected by a lead to switch 54 as will again be recognized by one-skilled in the art as an hours set input, and, finally, a connection for a lead that is tapped to a lead from switch 66 connected to NAND gates 58 and 60 that will also be readily recognized by a person skilled in the art as a seconds-date demand input.

A similar chip 14 is also provided formed of a similar inverter and divider circuits.

In the drawing chip 14 is in reality a duplicate of chip 12 shown to be turned over so that the connections on the right side of chip 12 are on the left side of chip 14 and the connections on the left side of chip 12 are on the right side of chip 14. As can be seen some connections of chip 12 are left out of chip 14 and some additional connections are utilized for chip 14. As for the different connections, there is first on the right side adjacent the bottom shown a connection to a lead from exclusive OR gate 50 for a reset signal hereinafter described, second there is a connection along the bottom, namely that shown to be the first in from the bottom right corner, with a lead to the other input of exclusive OR gate 36 wherby chip 12 and chip 14 may be synchronized within the framework of the pulse signals to the digit driver 72 without the need for the other connections utilized by chip 12 to leads to the digit driver, thirdly, and skipping across the connection on the bottom middle of chip 14 to a lead to a positive power source, there is shown an additional connection for chip 14 with respect to chip 12 to a lead to a diode bridge circuit shown about the left side of chip 14 to a connection at the top left corner to thereby provide a 60 cycle pulse to clamp chip 14 to hold selected output pulses to exclusive OR gates 16, 18, 20, 22, 24, 26, 28 and 30 on the appropriate leads connecting them to chip 14, fourthly, and skipping across the connection at the bottom left corner to the lead from NAND gate 38, there is a connection on the lower left side to the ground lead from another connection further up the left side. It should also be observed in the drawing that the output connections of chip 14 to the exclusive OR gates 16 through 30 are connected to additional transmission gates 78 and 80 having output leads tapped into output leads of transmission gates 82 and 84 connected to separate ones of the eight transistor means of the segment driver 86 having a common collector-connection to the positive power source and individual emitter connections to leads to digital display means 88.

A plurality of exclusive OR gates 16, 18, 20, 22, 24, 26, 28, and 30 are connecting chips 12 and 14 in a comparator circuit. As is known to those skilled in the art the outputs of chips 12 and 14 to the exclusive OR gate 16 through 30 tapped, respectively as shown, to transmission gates 82,84 and 78,80 form the *a, b, c, d, e, f, g* and AM/PM pulses for segment driver 86 whereby respective portions of the digital display means 88 are activated in accordance with the proper time frame of *ds* 1, *ds* 2, *ds* 3 and *ds* 4 pulses of digit driver 72 also controlled by chip 12 with which chip 14 is synchronized.

Signals from exclusive OR gates 16, 18, 20, and 22 are directed to NOR gate 32, and signals from exclusive OR gates 24, 26, 28, and 30 are directed to NOR gate 34.

NAND gate 38 is connected via inverter 40 to exclusive OR gate 36 and to chip 12 and circuit 10. Exclusive OR gate 36 is connected to similar outputs of similar circuits within chips 12 and 14. NAND gate 38 provides a signal to chip 14 to activate the divider circuit therewithin in accordance with signals of circuit 10 under control of exclusive OR gate 36.

An alarm, such as a buzzer 42, which could be a miniature speaker or other alarm means, is controlled by an alarm logic circuit including NAND gate 44 controlled by NOR gates 32 and 34 for commanding a signal to invertor 46 to activate alarm 42 when desired, and through NAND gate 48 and exclusive OR gate 50 deactivate chip 14 by resetting it as will be discussed hereinafter.

NAND gate 52 connected to an hours set switch 54 and inverter 56 controls the programming of chip 14 in accordance with watch logic circuit including control NAND gates 58 and 60 controlled by hours and minutes switch 74 and seconds, date demand switch 66 or the latter and exclusive OR gate 64. NAND gates 68 and 70 are connected in feedback relationship and are driven by NAND gates 58 and 60. In such feedback relationship they act as flip-flops to connect either chip 12 or chip 14 through transmission gates 78, 80, 82, and 84 to the segment driver 86. The demand hours and minutes switch 74 also controls gates 76 in association with hours set switch 54. The gates 76, 78, 80, 82 and 84 are constructed alike, as shown by the drawing, to include four assemblies of a PNP Fet and an NPN Fet connected in parallel with inverted gate connections readily familiar to those skilled in the art with gate 76 controlling the program-display mode of operation of chips 12 or 14 and the other gates 78, 80, 82 and 84 controlling segment driver 86. The watch circuitry is completed by the use of transmission gates, 78, 80, 82 and 84 connected between chips 12 and 14 and segment driver 86 for display 88 also connected to digit driver 72.

As will be familiar to those skilled in the art of binary divider circuits like those within chips 12 and 14 transmit digit select pulses in a sequence of 4, namely *ds*1, *ds*2, *ds*3, and *ds*4. The exclusive OR gate 36 is connected to chips 12 and 14 to be controlled by the *ds*1 pulses therefrom. By this type of connection chips 12 and 14 operate when *ds*1's are synchronized whereby chip 14 is connected by NAND gate 38 to circuit 10. The actual time of the alarm now may be set by operating switches 74 and 66 momentarily and then switches 74 and 54. This then will program chip 14 to the desired minutes for activation of the alarm by advancing the minutes at a second rate. For setting the hours of chip 14, all that is needed, after setting the minutes or after operating switches 74 and 66, is to operate switch 54 by itself. During this time and by reason of the activation of switches 74 and 66 the gates 68 and 70 prevent interference with the count of chip 12. Upon release or deactivation of switches 74 and 54 chip 14 will be programmed to a desired time and will not be counting. By saying not counting is meant that chip 14 is providing pulse signals of a preselected order for the *a, b, c, d, e, f, g* and AM/PM signals connected by leads to the exclusive OR gates 16 through 30, which pulse signals do not change as their counterparts from chip 12 do as the hours, minutes and seconds advance in chip 12. After programming chip 14, an activation of switch 66 returns the display 88, which has been activated to visually permit recognition of the desired programmed time, to the control of chip 12. The comparator logic of exclusive OR gates 16, 18, 20, 22, 24, 26, 28 and 30 act as comparators all the logic from chips 12 and 14 including AM and PM. In other words, if the timepiece is a 12 hour, as contrasted with a 24 hour watch, it is desirable to have the alarm operative only during the AM or PM portion of a day as programmed and this is possible because of the comparison of the AM and PM modes for chips 12 and 14.

Once the count of chip 12 reaches the programmed time in chip 14 the aligned output signals of NOR gates 32 and 34 operate NAND gate 44 to activate alarm 42. By this is meant that the pulse signals *a* through *g* and AM/PM of chips 12 and 14 are synchronized in the proper *ds* 1, 2, 3 and/or 4 time frame such that-NOR gates 32 and 34 provide the proper signals to NAND gate 44 to activate alarm 42. When chip 12 advances the count to the next minute the signal from the comparator circuit stops. This is because of the connection of NAND gate 48 not only to the signal from NAND gate 44 via inverter 46 but to the display demand normal output of chip 12 which will change its state after 60 seconds to that of the inverted signal from 46 to 48 whereby exclusive OR gate 50 is controlled by chip 12 via the output of NAND gate 48 will, after 1 minute, which is the time the alarm 42 operates automatically, reset the chip 14 to 0:00 where it will be dormant until reprogrammed. The alarm may be turned off by actuating switches 74 or 66 to inquire the time of chip 12 in less than 1 minute, or by simultaneous actuation of switches 74, 66 and 54 before the alarm time.

It may thus be realized that the foregoing takes advantage of the low power requirements of CMOS technology and further reduces power requirements by rendering the alarm means inactive except when setting (programming) and operating for 1 minute or less.

Having illustrated and described the invention, I claim and desire to protect by Letters Patent:

1. An electronic timepiece comprising:

a means to generate a high frequency time-standard signal;

a first divider means connected to said means to generate a high frequency time standard signal for producing low frequency signals in the form of segment driver pulses and digit driver pulses in response to said time standard signal;

segment driver means connected to said first divider means to receive said segment driver pulses therefrom;

digit driver means connected to said first divider means to receive digit driver pulses therefrom;

digital display means connected to said segment driver means and said digit driver means for the digital display of time;

a second divider means connected by a first logic gate means controlled by a digit pulse connection from said second divider means and a digit pulse connection from said first divider means for delivery of an output to an inverter connected to a second logic gate means input having another input connection from said means to generate a high frequency time signal such that said second divider means may be synchronized with said first divider means, said second divider means being also productive of segment driver pulses for connections to said segment driver means;

a diode bridge circuit connection between portions of said second divider means to clamp a predetermined order of segment driver pulses to be eminating from said second divider means coordinated with a predetermined digit driver pulse;

pure logic comparator means connected between said first divider means and said second divider means, said pure logic comparator means comprising a plurality of exclusive OR gates having a first input connection of each connected to the connections of said first divider means to said segment driver means and second input connections to the connections of said second divider means to said segment driver means, said exclusive OR gates being paired to provide a plurality of first output connections and a plurality of second output connections;

logic switch means including a first NOR gate and a second NOR gate whose inputs are connected, respectively, to said first output connections and said second output connections of said pure logic comparator means to control a NAND gate having its inputs connected to the outputs of said first NOR gate and said second NOR gate such that there is produced a signal when said first divider means and said second divider means are producing comparable pulses in said connections to said segment driver means and said exclusive-OR gates; and indicator means connected to the output of said NAND gate of said logic switch means to be actuated by signals therefrom.

2. The structure of claim 1 and further comprising a means connected to the output of the NAND gate of said logic switch means to limit the duration of the signal therefrom including, another NAND gate with input connections one of which is to the first said NAND gate of said logic switch means and another of which is to said first divider means output connection to gate means controlling the digit driver means, an exclusive OR gate connected to the output of said another NAND gate and having an output connection to said second divider means, and a capacitor circuit between said NAND gate and said indicator means and said another NAND gate.

3. The structure of claim 1 and further comprising means connected between said logic switch means and said second divider means to deprogram said second divider means upon deactivation of said indicator means.

4. The structure of claim 1 and further comprising gate means in a circuit between said display means and said first divider means and a means to set said second divider means to selectively connect the digital display means to said first divider means or said second divider means to visually display present time of the timepiece or programmed time for the alarm means.

5. The structure of claim 2 wherein said exclusive OR gate in said logic switch means controlled by said another NAND gate connected to said first divider means has its output connected to a master reset of said second divider means to deprogram said second divider means upon deactivation of said indicator means.

6. The structure of claim 2 and further comprising manual switch connections to another gate means in a circuit to said first divider means and to said second divider means to selectively connect the digital display means to said first divider means or said second divider means to visually display information of the first divider means or programmed time of the second divider means.

7. The structure of claim 2 wherein said exclusive OR gate connected to the output of said another NAND gate has another input from logic means that has connected thereto manual switch means to override the control of the duration of the signal from the logic switch means.

8. In an electronic timepiece having a tank circuit for a binary divider chain operatively connected to segment driver transmission gate means and to digit driver means for control of a digital display means selectively operable by manual switch means connected by logic means to the binary divider chain, the improvement of an alarm means comprising:

another binary divider chain connected by a synchronization logic circuit to said tank circuit for providing information to the segment driver transmission gate means from said another binary divider chain that is equivalent to that from the timepiece binary divider chain;

a gate circuit connected between the timepiece binary divider chain and said another binary divider chain including a plurality of exclusive OR gate means each having an input from the timepiece binary divider chain and another input from said another binary divider chain which are paired to portions of the transmission gate means to provide a comparator circuit means having output signals; and alarm means connected by logic gates to said gate circuit to be operable whenever said output signals are comparable.

* * * * *